United States Patent [19]

Denholm et al.

[11] Patent Number: 4,514,222

[45] Date of Patent: Apr. 30, 1985

[54] HIGH INTENSITY LEAD SMELTING PROCESS

[75] Inventors: William T. Denholm, Camberwell; John M. Floyd, Glen Waverley; William J. Errington; Anthony N. Parry, both of Mount Isa, all of Australia

[73] Assignee: Mount Isa Mines Limited, Queensland, Australia

[21] Appl. No.: 442,656

[22] Filed: Nov. 18, 1982

[30] Foreign Application Priority Data

Nov. 26, 1981 [AU] Australia ..... PF1721

[51] Int. Cl.[3] ..... C22B 13/00

[52] U.S. Cl. ..... 75/77

[58] Field of Search ..... 75/6, 77, 23, 26, 24, 75/92; 423/419

[56] References Cited

U.S. PATENT DOCUMENTS

| | | | |
|---|---|---|---|
| 1,922,301 | 8/1933 | Kekich | 75/77 |
| 3,326,671 | 6/1967 | Worner | 75/77 |
| 4,266,971 | 5/1981 | Schwartz | 75/77 |
| 4,391,632 | 7/1983 | Aaltonen et al. | 75/77 |
| 4,396,426 | 8/1983 | Jensfelt et al. | 75/23 |

FOREIGN PATENT DOCUMENTS

| | | | |
|---|---|---|---|
| 922904 | 3/1973 | Canada | 75/6 |

*Primary Examiner*—M. J. Andrews

*Attorney, Agent, or Firm*—Darby & Darby

[57] ABSTRACT

Lead is obtained from lead sulfide ores or concentrates without prior sintering or roasting by the steps of adding the lead sulfide to a molten slag, injecting sufficient oxide to below the surface of the molten slag and vigorously agitating the slag whereby substantially to oxidize the lead sulfides to lead oxides, and then reducing the lead oxides. The slag is preferably agitated by means of a lance. The reduction stage may follow the oxidation stage in the same vessel or may be conducted in another vessel.

9 Claims, No Drawings

HIGH INTENSITY LEAD SMELTING PROCESS

BACKGROUND OF THE INVENTION

Lead smelting has in the past been carried out in an ore hearth process but is now most usually conducted by a sintering process. In the hearth process with the furnace in blast at 920° C. to 985° C., ore was charged to float on a bath of molten lead. Air was blown onto the surface whereby lead sulfides were oxidized to lead metal. Alternate layers of coke breeze ensured that lead sulfide oxidized to lead oxide was reduced to lead. Slag forming constitutents of the ore fused and were skimmed from the surface. Molten lead was tapped from the hearth. Only ore concentrates of lead content 70% or higher were considered amenable for such smelting. Typically about 35% of the ore charge became fumed and was recycled.

The sintering process is now the process in general use. Typically pelletized feed is oxidized on a travelling grate. Excess air is drawn through the charge and sulphur dioxide formed is drawn off to inhibit sulfate formation. There is produced on the grate a sinter of lead oxide together with the formation of lead silicates and oxides of zinc, iron and other metals depending on the composition of the ore sintered. The sinter is subsequently conveyed to a blast furnace wherein the oxides are reduced to metals with coke and are separated.

U.S. Pat. No. 3,281,237 proposed a process in which a gas suspended particulate lead sulfide and an oxygen containing gas were introduced concurrently beneath the surface of a pool of molten lead with the object of oxidizing the lead sulfide to molten lead in a continuous single stage operation. The process as described was not developed past the pilot plant stage due among other problems to continued failure of the refractory lining.

U.S. Pat. No. 3,941,587 proposed a process in which a molten bath comprising a metal rich phase and a slag phase is established and maintained beneath a sulphur dioxide gas phase in an elongated tiltable refactory lined sealed furnace. Oxygen is introduced below the surface with a minimum of bath turbulence so as not to interfere with a flow of metal rich and slag phases and a specially arranged oxygen activity gradient towards opposite ends of the near horizontal furnace.

Australian Pat. No. 502,696 relates to a method for the reduction of lead oxide by injection of a mixture of a fuel with air into a bath of molten oxide in a slag, while adding a carbonaceous reducing agent in the form of particles of 1 cm or larger.

SUMMARY OF THE INVENTION

The present invention provides a lead smelting method which in preferred embodiments is relatively simple to conduct and is relatively economical in comparison with methods currently practised on a commercial scale.

According to one aspect the invention consists in a process for smelting lead sulfide ores, concentrates and the like characterised by the steps of:

(1) adding the lead sulfide to a molten slag, (2) injecting sufficient oxygen below the surface of the molten slag and vigorously agitating the slag whereby substantially to oxidize said lead sulfides to lead oxides, and (3) subsequently reducing the lead oxides.

DESCRIPTION OF PREFERRED EMBODIMENT

In a preferred embodiment, the invention is conducted as a two stage process whereby metallic lead is obtained from lead sulfide concentrates without prior sintering or roasting of the concentrates. Both stages of the process are carried out in a stationary, refractory lined vessel in which a molten silicate slag is maintained in a vigorously agitated condition by means of gases injected downwards through a lance submerged in the bath. In the smelting stage of the process the lead sulfide ore or concentrate plus suitable flux material is fed into the bath and sufficient oxygen containing gas is injected below the surface of the bath through the lance to completely oxidise the sulfides to oxides. In this way a lead oxide rich slag, whose composition is defined by the composition of the feed but which may typically contain in excess of 50% lead as oxide, is formed.

The second stage of the process consists of reducing the lead oxide to lead metal, for example, by the addition of carbonaceous material to the slag. Further addition of carbonaceous material can be made to reduce any zinc oxide present in the slag.

The process may be carried out batchwise with a reduction cycle following an oxidising cycle in the same reaction vessel, or the process may be made continuous by use of two compartments or reaction vessels, one compartment or vessel for oxidation and one for reduction.

The discard slag from the normal reduction stage typically has a high zinc content. This zinc may be recovered in the form of the oxide, by addition of a zinc fuming stage to the process.

By way of further example, the process may be conducted in a furnace of very simple and compact design, preferably a stationary, vertical, water-jacketed or refractory lined steel shell of cylindrical shape. The process is conducted using a silicate slag which is maintained at a temperature of approximately 1000° C. to 1250° C. depending on slag composition, the temperature being selected to maintain slag fluidity.

Lead concentrates are added to the fluid slag. The composition of various lead sulfide feeds which have been treated is shown by way of example in Table 1. Feeds have included concentrates and preconcentrates from heavy medium separation. Feed preparation may be minimal. The feed may be in any physical form which will not be blown out with the flue gases. Concentrates have been fed to the furnace in the form of dry pellets, wet pellets and wet filter cake mixed with the appropriate fluxes and fume recycle. Feed of the concentrate as a slurry appears to be feasible. Dry powdered concentrate may if desired be injected into the bath through the lance.

Oxygen, either as air or an oxygen enriched air stream, is injected vertically downwards to beneath the surface by means of one or more lances, preferably a "Sirosmelt" lance such as is described in U.S. Pat. No. 4,251,271. The gases injected by means of the lance maintain the slag in a vigorously agitated condition. The vigorous agitation imparted to the bath ensures high rates of heat and mass transfer and thus high overall rates of the chemical reactions involved. Smelting rates of 0.7 tonne/hour per cubic meter of the smelting vessel can be achieved.

The lead sulfides are oxidized substantially to lead oxide. Control of oxidation potential and the temperature of the process is readily achieved by varying the air and fuel flows through the lance. In the smelting stage of the process, the oxidation of the lead sulphide occurs very rapidly and so fume losses due to volatilisation of the lead sulfide are maintained at a low value.

Fume generation may be minimised by maximising the rate of oxidation of the lead sulfide concentrate. To this end it is desirable to maintain a highly fluid slag and use an excess of oxygen over the stoichiometric requirement.

The fume produced is collected and may be recycled with the feed material.

Subsequently the lead oxide rich slag may be treated by addition of lump coal to reduce the lead oxides in the same vessel to produce a low sulphur lead bullion, or the smelted lead slag may be transferred to another vessel or compartment for continuous or batch reduction in another vessel.

If desired lump coal (−50 mm) can be added with the concentrate feed without further preparation to provide part or all of the process heat requirements in the smelting stage. The stoichiometry is then adjusted by means of the air rate through the lance to provide the desired conditions for combustion.

Examples 1 to 3 illustrate operating conditions of the process with various feed and feed supplement compositions.

EXAMPLE 1

This example illustrates the use of the process in the batch oxidation smelting/batch reduction mode of operation.

180 kg of dry pelletised lead concentrates were fed at a rate of 2 kg/min into a furnace containing 55 kg of a molten iron silicate slag.

Oil and air were injected through a lance into the slag bath to maintain the smelting temperature at 1250° C. and to provide adequate excess air to fully oxidise the sulfides in the concentrate.

During the smelting stage, 19% of the lead in feed reported to fume, the remainder reporting to the slag phase.

On completion of the oxidation smelting stage the air/oil ratio through the lance was changed to provide reducing conditions in the bath and 10 kg of lump coal was added to the bath at a rate of 0.4 kg/min.

During the reduction stage the temperature was maintained at 1150° C. and 9% of the lead in the bath reported to fume.

On tapping lead bullion and a residual slag containing 5.2% lead was obtained. Further details are shown in Table II.

EXAMPLE 2

This example illustrates the use of wet filter cake as a feed material. By batch smelting into an initial bath consisting of a high lead slag, the lead content of the slag increased above 40% during smelting and allowed the smelting temperature to be gradually dropped to below 1100° C.

360 kg of lead concentrate filter cake (14% moisture) were fed to a furnace containing 100 kg of a lead oxide-rich slag from a previous experiment. Air and oil were injected into the slag bath through a lance to maintain the required bath temperature and to fully oxidise the sulfides in the concentrate.

| Smelt | Average Lead Content of Bath | Mean Temp. °C. | Fume Generated (% of Pb in Feed) |
|---|---|---|---|
| 0–120 kg | 37% | 1200° C. | 32% |
| 120–240 kg | 43% | 1160° C. | 18.5% |
| 240–360 kg | 47% | 1070° C. | 11.9% |

The resulting high lead slag was reduced by the addition of 26 kg of lump coal at a rate of 0.8 kg/min with lance injection as in example 1 and temperature of 1150° C. On tapping, 96 kg of lead bullion and 143 kg of a slag containing 2.6% lead was obtained. The half time of reduction was seven minutes and less than 7% of the lead in the bath was fumed during the reduction. Further details are shown in Table III.

EXAMPLE 3

This example illustrates the use of the process in the semi-continuous mode of operation to smelt lead concentrate filter cake to produce a lead oxide-rich slag. Continuous or semi-continuous low temperature smelting at steady state conditions offers significant advantages over batch operation in terms of ease of operation of the process and reduced fuel requirement and refractory wear.

9.2 tonnes of lead concentrate in the form of wet filter cake (14% moisture) was fed to the same furnace used for examples 1 and 2 together with the required fluxes, and sufficient air was injected through the submerged lance to fully oxidise the sulfides in the concentrate. Oil was injected through the lance to maintain an average temperature of 1120° C. throughout the experiment. Smelting was interrupted after approximately each 300 kg of concentrate to allow tapping of a proportion of the high lead slag produced.

Approximately 18% of the lead in feed reported to fume. This fume was collected at intervals from the baghouse, mixed with water to form a cake and recycled to the furnace with the lead concentrate feed.

11.2 tonnes of high lead slag with an average lead content of 47% was produced. Further details are shown in Table IV.

In general, preferred embodiments of the invention provide a number of advantages including:

(i) Satisfactory smelting rates may be achieved with relatively simple equipment.

(ii) Fume losses may be maintained at a low level.

(iii) Feed preparation is minimal and drying unnecessary.

(iv) The process is simple to control and relatively economical to conduct.

The process conditions and apparatus employed may be varied to an extent which will be apparent to those skilled in the art without departing from the inventive concept disclosed herein.

TABLE I

ANALYSIS OF FEEDS USED IN SMELTING RUNS AND STOICHIOMETRIC REQUIREMENTS FOR COMPLETE OXIDATION

| SAMPLE | A | B | C | D | E | F |
|---|---|---|---|---|---|---|
| ANALYSIS | | | | | | |
| Pb | 48.8 | 51.7 | 52.8 | 68.8 | 78.3 | 8.35 |
| Zn | 6.2 | 6.59 | 7.14 | 6.38 | 2.50 | 9.38 |
| Fe | 10.8 | 11.6 | 9.7 | 4.3 | 1.85 | 13.95 |
| S | 21.2 | 22.9 | 21.6 | 17.6 | 14.6 | 14.6 |
| Ag | — | — | 1500 | — | — | 222 |
| Cu | 0.24 | — | 0.35 | — | — | — |

TABLE I-continued

ANALYSIS OF FEEDS USED IN SMELTING RUNS AND STOICHIOMETRIC REQUIREMENTS FOR COMPLETE OXIDATION

| SAMPLE | A | B | C | D | E | F |
|---|---|---|---|---|---|---|
| CaO | 0.62 | 1.0 | — | 0.5 | — | 7.4 |
| $SiO_2$ | 10.7 | 2.50 | — | 0.9 | — | 19.2 |
| $Al_2O_3$ | 0.94 | — | — | — | — | 3.83 |
| MgO | 0.45 | — | — | — | — | 3.63 |
| (1)STOICHIOMETRY RATIO | | | | | | |
| ml/g cons. | | | | | | |
| $O_2$ | 208.7 | 224.4 | 213.0 | 180.5 | 151.2 | 152.9 |
| AIR | 993.8 | 1068.6 | 1014.3 | 859.5 | 720.0 | 728.1 |
| ml/g Pb | | | | | | |
| $O_2$ | 427.7 | 434.0 | 403.4 | 262.4 | 193.1 | 1831.1 |

NOTES:
(1)STOICHIOMETRY RATIO CALCULATED FOR COMPLETE REACTIONS: SULPHIDES - OXIDES

TABLE II

| | |
|---|---|
| Concentrate Feed: | 180 kg dry pellets (less than 2% $H_2O$) |
| Feed Supplement: | 25 kg $SiO_2$, 4.5 kg CaO, 32 kg recycle fume (70% Pb) |
| Smelting Air Requirements: | 1.47 $Nm^3$/kg dry concentrate |

| MATERIAL COMPOSITION | A | B | C | D |
|---|---|---|---|---|
| Pb | 49.9 | 1.7 | 38.8 | 5.2 |
| Zn | 6.94 | 0.52 | 5.4 | 5.8 |
| Cu | 0.42 | 0.28 | 0.33 | 0.05 |
| Fe | 11.9 | 35.8 | 16.1 | 29.3 |
| CaO | 1.27 | 13.2 | 6.5 | 10.2 |
| $SiO_2$ | 2.9 | 30.8 | 21.8 | 30.6 |
| S | 22.5 | 0.29 | 0.15 | 0.01 |
| $Fe_3O_4$ | — | 2.0 | 14.0 | 1.3 |

A — Dry concentrate
B — Initial bath
C — Bath at end of smelt
D — Slag after reduction

TABLE III

| | |
|---|---|
| Concentrate Feed: | 360 kg of wet filter cake (14% $H_2O$) |
| Feed Supplement: | 46 kg $SiO_2$, 9 kg CaO, 54 kg recycle fume (70% Pb) |
| Smelting Air Requirements: | 1.46 $Nm^3$/kg dry concentrate |

| MATERIAL COMPOSITION | A | B | C | D |
|---|---|---|---|---|
| Pb | 49.2 | 28.0 | 47.9 | 2.58 |
| Zn | 6.32 | 5.7 | 4.9 | 9.58 |
| Cu | 0.34 | 0.46 | 0.31 | 0.05 |
| Fe | 12.0 | 18.4 | 14.9 | 30.0 |
| CaO | 1.2 | 6.2 | 5.7 | 9.3 |
| $SiO_2$ | 2.95 | 20.4 | 16.5 | 28.7 |
| S | 22.4 | 0.26 | 0.29 | 0.13 |
| $Fe_3O_4$ | — | 2.4 | 11.7 | 1.0 |

A — Dry concentrate
B — Initial bath
C — Bath after 360 kg smelt
D — Slag after reduction

TABLE IV

| | |
|---|---|
| Concentrate Feed: | 10.7 tonnes wet filter cake 14% moisture) (9.2 tonnes dry concentrate) |
| Feed Supplement: | 1.5 tonnes $SiO_2$: 0.5 tonnes CaO |
| Feed Rate: | 2 kg/min of filter cake |
| Smelting Air Requirements: | 1.4 $Nm^3$/kg dry cons |

| MATERIAL COMPOSITION | A | B |
|---|---|---|
| Pb | 51.8 | 47.3 |
| Zn | 7.0 | 6.4 |
| Cu | 0.32 | 0.28 |
| Fe | 10.25 | 15.0 |
| CaO | 1.3 | 5.3 |
| $SiO_2$ | 3.5 | 15.3 |
| S | 21.2 | 0.51 |
| $Fe_3O_4$ | — | 9.9 |

A — Dry concentrate
B — High lead Slag Produced (typical assay)

We claim:

1. A method of smelting a concentrate containing lead sulfide characterized by the steps of:
   (1) adding the lead sulfide concentrate to a refractory lined reactor containing iron oxide in a molten, highly-fluid, silicate slag bath maintained in a strongly oxidized and vigorously agitated condition;
   (2) mixing all the metal sulfides that are members of the group consisting essentially of lead sulfide, zinc sulfide, copper sulfide, calcium sulfide, bismuth sulfide, silver sulfide, magnesium sulfide and aluminum sulfide in the silicate slag bath to form a single phase;
   (3) maintaining the single phase slag bath in a vigorously agitated, strongly oxidized condition and at a predetermined temperature by injecting hot combustion gases with air in excess of that required to convert all the sulphides to their corresponding oxides through a downwardly extended lance having an outlet submerged in the silicate slag bath;
   (4) oxidizing said metal sulfides to their corresponding metal oxides to produce a silicate slag bath rich in lean oxide; and
   (5) adding lump coal to the silicate slag bath to reduce the lead oxide to elemental lead.

2. A method according to claim 1 wherein the reducing step is performed in a different vessel from the oxidizing step.

3. A method according to claim 1 wherein steps (1), (2) and (3) proceed concurrently and continuously in one vessel and wherein step (4) is conducted substantially continuously in another vessel.

4. A method according to claim 1 further comprising maintaining the temperature of the molten slag at between 1000° and 1250° C. during the oxidizing step.

5. A method according to claim 1 further comprising adding a flux with the lead sulfide concentrate to the slag bath.

6. A method according to claim 1 further comprising enriching the air with oxygen.

7. A method according to claim 1 further comprising agglomerating the lead sulfide concentrate and feeding it into the top of the reactor.

8. The method according to claim 7 further comprising wetting the agglomerated material.

9. A method according to claim 1 further comprising adding carbonaceous material to the molten slag to supply at least part of the heat requirements during the oxidizing step.

* * * * *